United States Patent [19]

McReynolds

[11] 3,971,346

[45] July 27, 1976

[54] ROTARY INTERNAL COMBUSTION ENGINE

[76] Inventor: William W. McReynolds, 6148 Elsa St., Lakewood, Calif. 90713

[22] Filed: Sept. 30, 1974

[21] Appl. No.: 510,419

[52] U.S. Cl. ..... 123/8.41; 60/901; 418/84; 418/138

[51] Int. Cl.[2] ..... F02B 53/08

[58] Field of Search ..... 123/8.23, 8.41, 179 B, 123/179 BG, 187.5 R, 196 S, 196 H; 418/84, 87, 100, 138, 241, 257

[56] References Cited

UNITED STATES PATENTS

| | | | |
|---|---|---|---|
| 1,306,699 | 6/1919 | Johanson | 123/8.41 |
| 1,365,226 | 1/1921 | Carroll | 418/138 |
| 1,372,750 | 3/1921 | Hejhal | 418/241 X |
| 1,748,568 | 2/1930 | Grover | 123/8.41 |
| 2,129,431 | 9/1938 | Lambin | 418/138 |
| 3,103,920 | 9/1963 | Georges | 123/8.41 |
| 3,324,840 | 6/1967 | Linn | 123/8.41 |
| 3,446,011 | 5/1969 | Ohno | 60/304 X |
| 3,537,432 | 11/1970 | Jordaan | 123/8.41 |
| 3,688,749 | 9/1972 | Wankel | 123/8.41 |
| 3,827,417 | 8/1974 | Morita | 123/187.5 R X |

FOREIGN PATENTS OR APPLICATIONS

| | | | |
|---|---|---|---|
| 477,598 | 7/1915 | France | 418/241 |

*Primary Examiner*—Carlton R. Croyle
*Assistant Examiner*—Michael Koczo, Jr.
*Attorney, Agent, or Firm*—Charles A. Goodall

[57] ABSTRACT

A rotary internal combustion engine comprising in combination rotary air compressor and rotary power sections having cylindrical chambers having rotatably mounted internal to each chamber a movable vane rotor assembly.

Each movable vane rotor assembly comprises a hollow cylindrical rotor having a movable vane assembly therein having a plurality of three or more vane pivotably connected to a floating vane shaft, said vanes being in sealable abutment with internal surfaces of said cylindrical chambers exterior to said rotor. Consecutive compartments are defined by adjacent vanes in combination with inner chamber and outer rotor and vane surfaces. Compressor and power rotors are connected to common shafts which extend through cover plates which partially enclose the compressor and power chambers.

Compressed air is ducted from the compressor to a power air intake port providing successive compartments with air, said air containing compartment further rotating to a fuel injection port and a fuel-air mixture igniter chamber, whereupon the fuel-air mixture is ignited and expands causing further rotor rotation. Spent fuel-air mixture is exhausted at a power exhaust port.

16 Claims, 25 Drawing Figures

FIG. 1
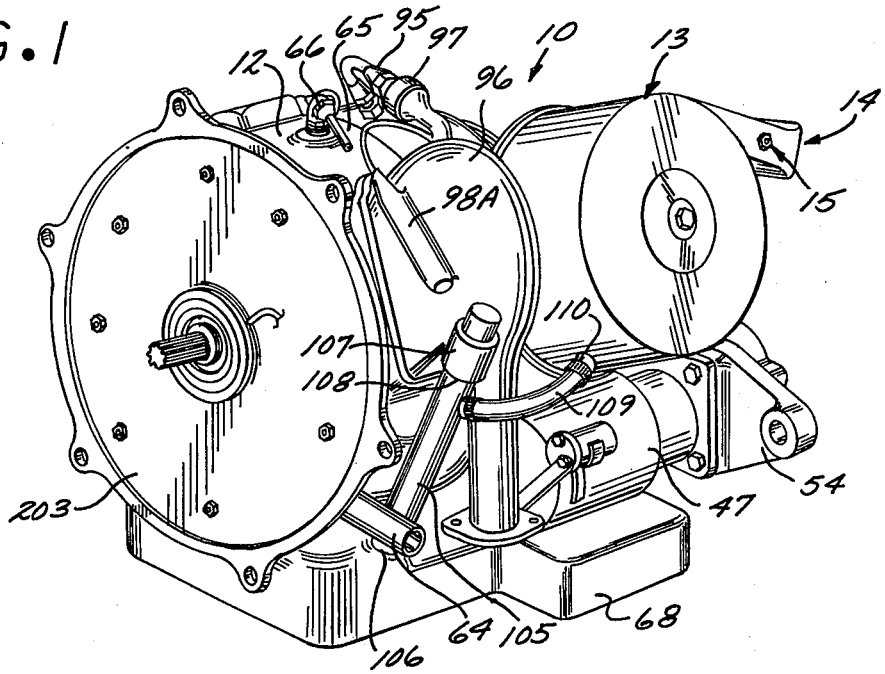
FIG. 2
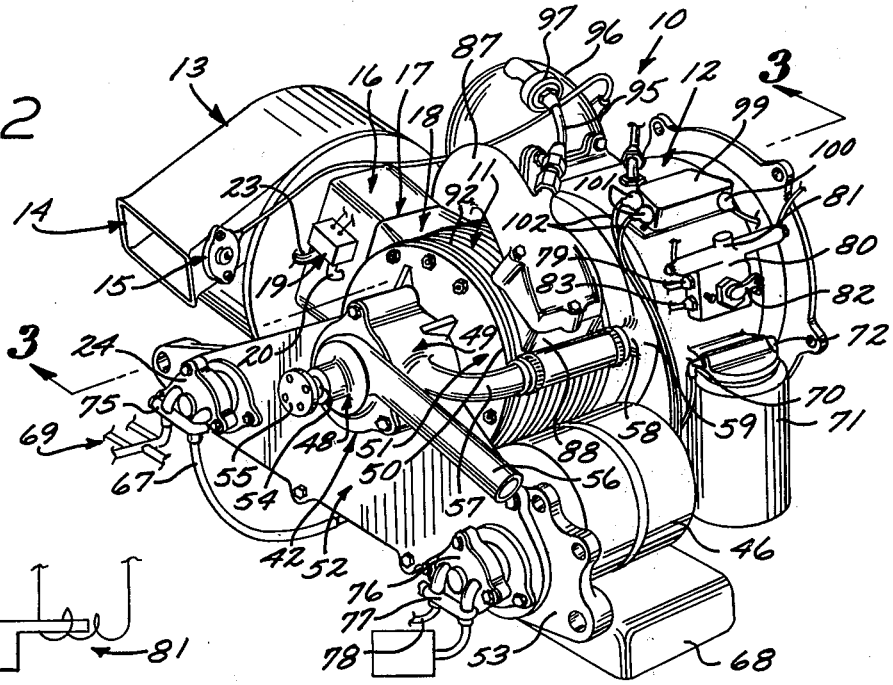
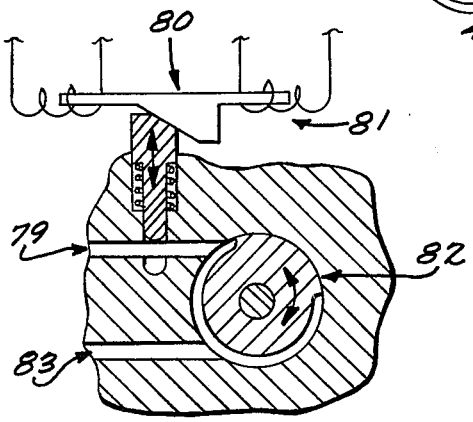
FIG. 16
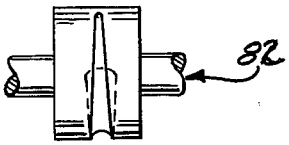
FIG. 17

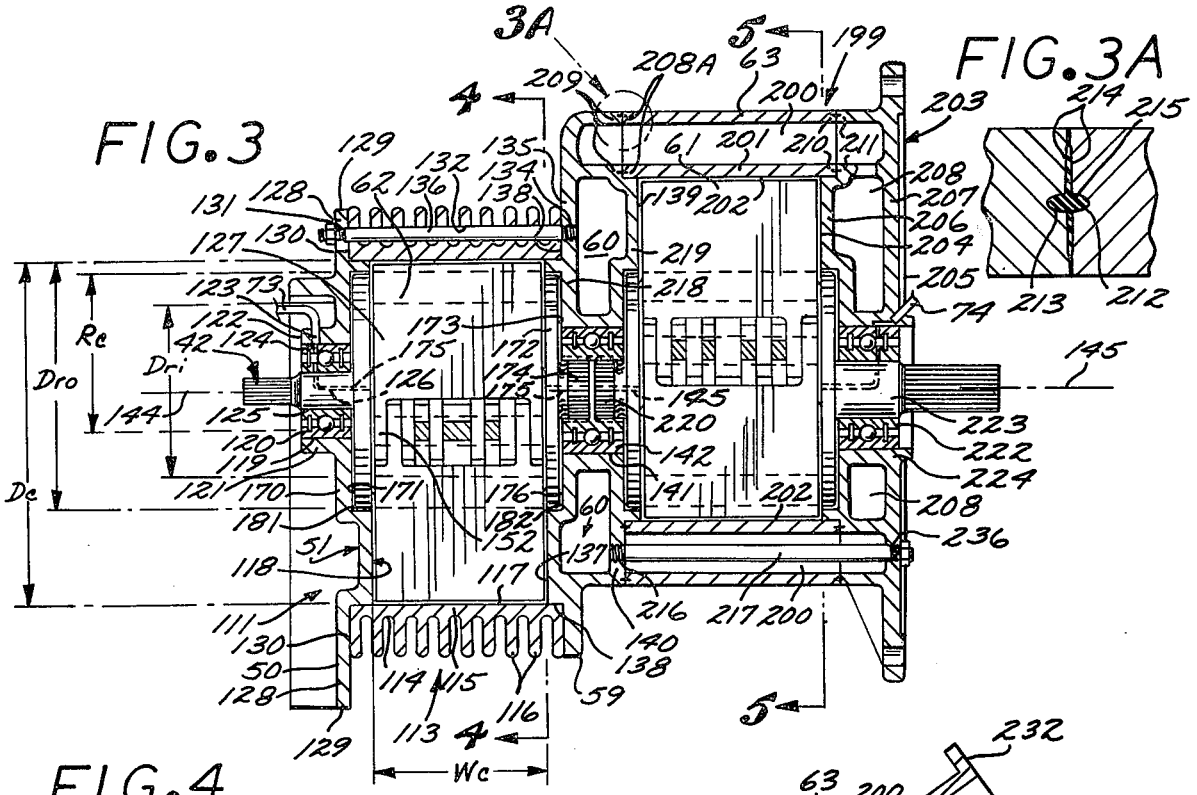
FIG. 3
FIG. 3A
3A
5
4
Dro
Dri
Rc
Dc
Wc
145
223
222
224
236
208
199
200
201
202
203
204
205
206
207
208
209
210
211
212
213
214
215
216
217
218
219
220
221
225
230
231
232
233
234
235
60
61
63
74
111
113
114
115
116
117
118
119
120
121
122
123
124
125
126
127
128
129
130
131
132
134
135
136
137
138
139
140
141
142
144
145
146
147
148
149
150
151
152
159
160
161
170
171
172
173
174
175
176
178
179
181
182
50
51
59
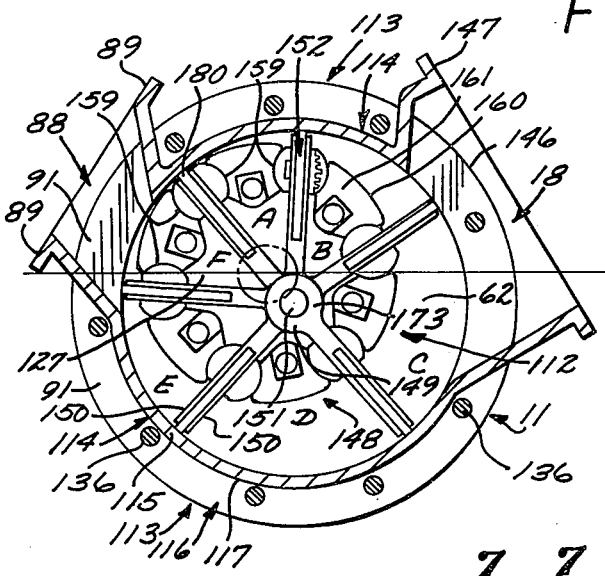
FIG. 4
89
91
88
159
180
152
113
114
147
161
160
146
18
A
B
C
D
E
F
62
173
112
149
148
150
151
136
115
116
117
11
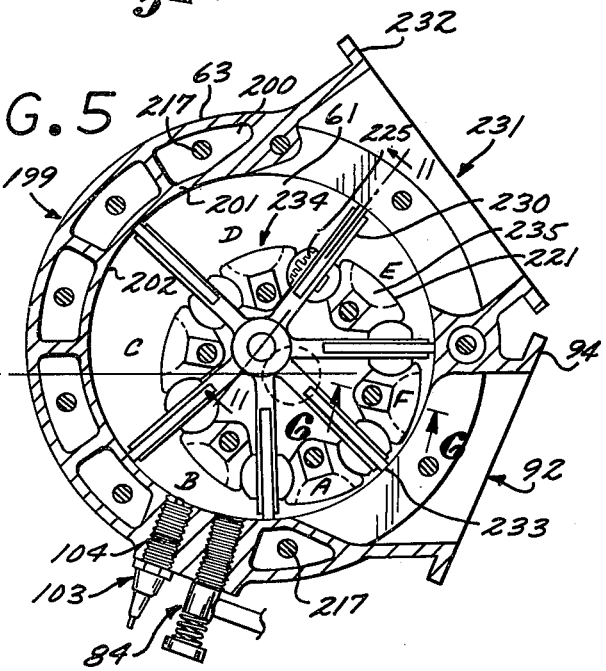
FIG. 5
232
63
200
217
61
225
231
199
201
234
230
235
221
94
92
233
202
A
B
C
D
E
F
G
104
103
84
217
11
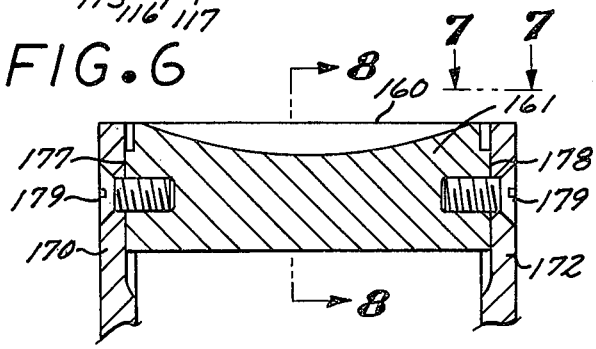
FIG. 6
7
7
8
8
160
161
177
178
179
179
170
172
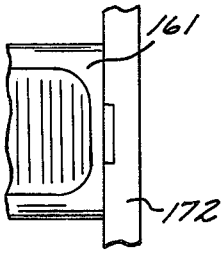
161
172
FIG. 7
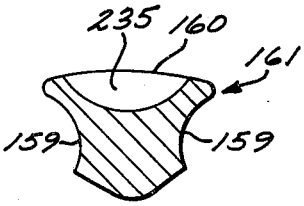
235
160
161
159
159
FIG. 8

FIG. 9
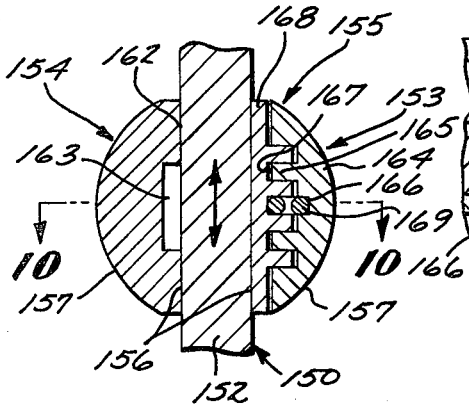
FIG. 10
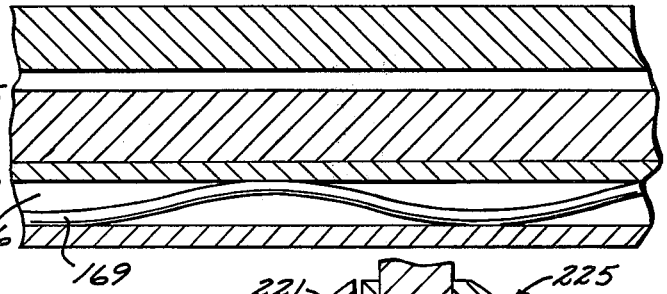
FIG. 9A
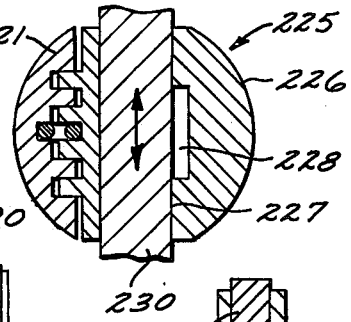
FIG. 11
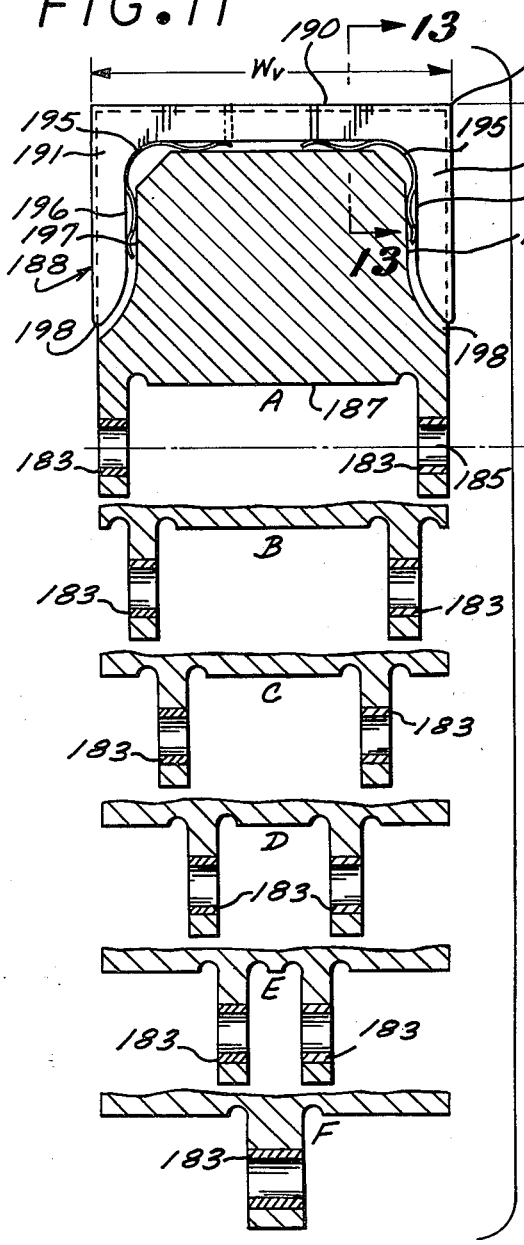
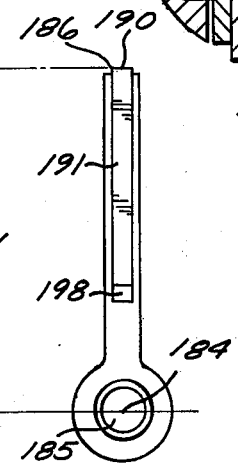
FIG. 12
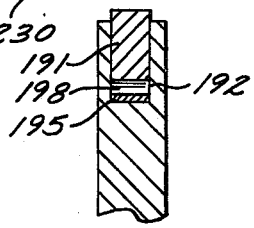
FIG. 13

FIG. 14
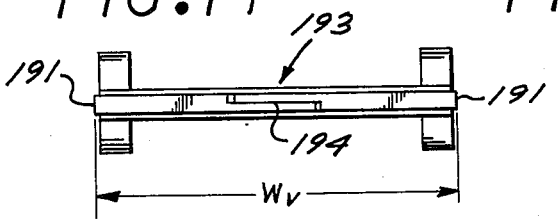
FIG. 15
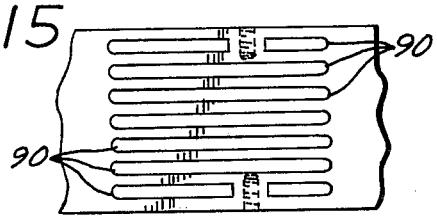
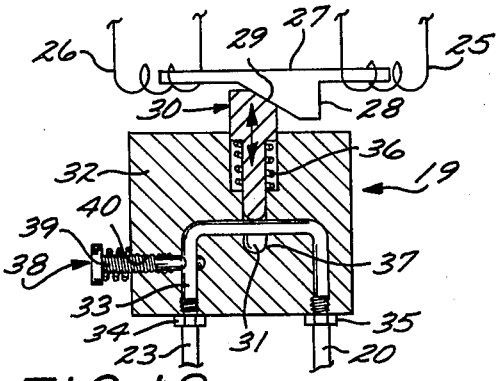
FIG. 18
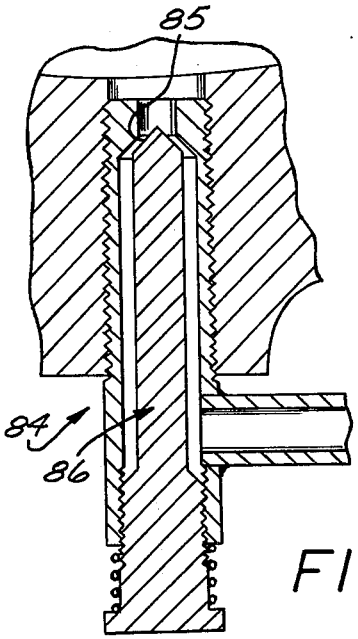
FIG. 21
FIG. 20
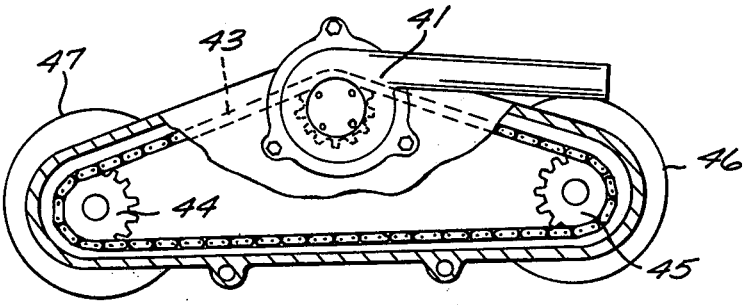
FIG. 22
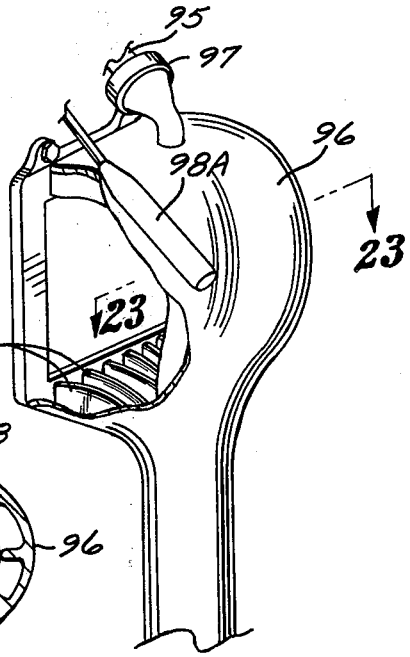
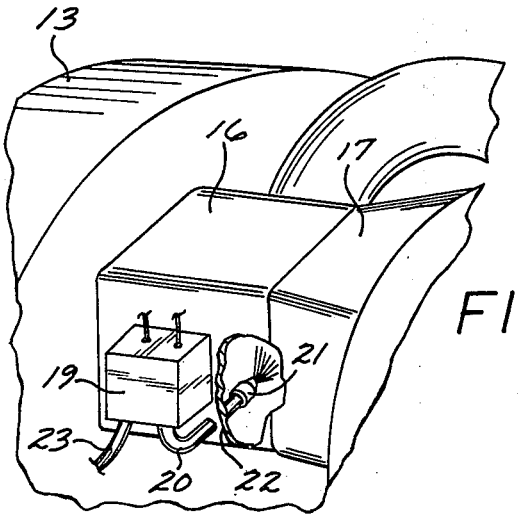
FIG. 19
FIG. 23
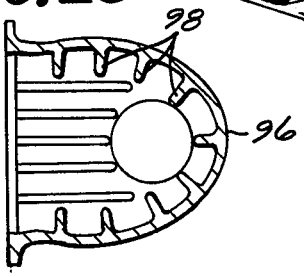

ROTARY INTERNAL COMBUSTION ENGINE

BACKGROUND OF THE INVENTION

1. Field of Invention

This invention relates to a rotary internal combustion engine of the rotary vane type and more particularly to a novel movable rotary engine comprising in combination a movable vane rotary air compressor section and a movable vane rotary power section wherein said compressor section and said power section have substantially identical movable vane rotor assemblies. The movable vane rotor assemblies synchronously rotate within respective compressor section and power section cylindrical chambers and, while rotating, the compressor delivers compressed air to a power section air intake port to compartments within the power chamber, said compartments being formed between successive vanes of a power vane rotor assembly as the power section rotor assembly rotates past the air intake port. Upon further rotation of the said compartment containing compressed air, past the air intake port, fuel is injected thereinto through a fuel injection port means forming an air-fuel gas expansion mixture which is thereafter ignited by an igniter means causing mixture expansion against compartment surfaces, with a greater area being exposed by a forward vane and thereby forcing the rotor to continue rotating past an exhaust port, each compartment so formed in succession continuing through the same cycle. The compressor section has an air intake port at a location where the compartments between adjacent vanes have the greatest volume and the compartments change to the smallest volume at the area of the compressor exhaust port. Each compartment of each compressor or power section continues through the same cycle as hereinabove described as the movable vane rotor assemblies rotate.

2. Discussion of the Prior Art

Rotary internal combustion engines are becoming increasingly recognized as replacements for the piston engine currently in wide use particularly in the automotive field. The rotary engine has fewer moving parts and promises greater fuel economy than the conventional piston engine. A number of rotary engines have been invented, one which has been used extensively being the two lobed epitrochoidal chamber having generally triangular shaped rotor type. This type of engine is difficult to manufacture and requires exacting chamber and rotor design parameters and the seal means are very critical. Good fuel economy and high compression ratios are difficult to achieve and high horsepower to weight ratios are also difficult to obtain, as they are with piston engines currently in use.

The movable vane rotary internal combustion engine has promise of overcoming some of these problems in that it is relatively simple to construct, it provides improved fuel economy and the octane of the fuel is not critical. It is possible to achieve high compression ratios with this engine, and high horsepower to weight ratios are readily obtainable. The majority of the inventions describing rotary vane internal combustion engines employ relatively complex rotor assemblies. In some, super chargers have been used to increase the compression ratios and auxiliary compressors have also been used for this purpose to deliver compressed air or compressed air-fuel mixtures to the power chamber.

Various vane rotor assemblies have been employed wherein the construction features range from those wherein the vanes are movably mounted in the rotor and are an integral part of it, with each vane located in a cavity in the rotor and being inwardly and outwardly movable therein, to those wherein the rotor and vane assembly are distinctly separate assemblies but are assembled to co-act with each other within the chamber defining the interior of the engine. One of these is described in Armstrong U.S. Pat. No. 3,451,381, which discloses a rotor mounted eccentrically in a cylindrical main chamber having a rotatable shaft mounted axially in the main chamber and passing through the interior of the rotor. A plurality of vanes are mounted on the shaft and pass through the rotor to engage their outer edges in sealing relation against the internal cylindrical surface of the main chamber, thereby defining a plurality of compartments of variable volume as the rotor rotates. One of the vanes has its inner end fixedly connected to the shaft with other vanes being rotatably mounted thereon. The rotor is bearingly mounted in the chamber end-plates and is thereby maintained in its eccentric position. The shaft onto which the vanes are mounted serves as the powere transmission means for the engine and passes through the rotor as aforesaid and also extends sealably through bearings in the main chamber end plates. This type of construction is relatively complex and presents a difficult design problem in sealing the expansion gases in the compartments formed by successive vanes as they rotate.

SUMMARY OF THE PRESENT INVENTION

The present invention comprises a uniquely constructed compressor section and power section, with the compressor section providing compressed air to the power section. A relatively simple and novel movable vane rotor assembly of substantially the same construction is provided for each of the two sections. The movable vane rotor assembly is simplified over the prior art in that the vanes are rotatably mounted on a floating shaft, said shaft being within a hollow cylindrical rotor having vanes extending movably inwardly and outwardly through vane apertures circumferentially distributed around a cylindrical surface of the rotor, the apertures being pivotable axially with respect to the rotor curved surface. Each of the vanes has a length from a floating shaft center position to a chamber abutting vane end substantially equal to the radius of the cylindrical chamber wherein the movable vane rotor assembly is mounted. The vanes have spring actuated seal means operably connected to the vane ends and vane sides. The floating shaft is centrally oriented on a true center with respect to the axis of the chamber. This orientation assures that the vane assembly will track on a true center of the floating shaft which always centers on the true center of the curved surface of the cylindrical chamber as the rotation velocity of the movable vane rotor assembly increases. The rotor of each assembly is mounted eccentrically with respect to the chamber in which it is mounted. The centrifugal forces acting outwardly from the floating shaft which would force the vanes against the curved surface of the cylindrical chamber were the vanes not so connected to the floating shaft, as is the case in many of the movable vane rotary engines, are cancelled out since the vanes are held in centered position by the floating shaft. Thus the seal and chamber curved surface wear due to friction is minimized. The invention employs a separate compressor section operating in tandem with a separate power section, employing substantially similar construction for each chamber and rotor assembly. The providing of compressed air to the power section is a further improvement in that higher compression ratios are achievable and blow-by, around the seals, of gases from high pressure compartments to adjacent compartments is minimized in this type of rotary internal combustion engine because gas pressure in the power section is maintained relatively high in compartments ahead and behind the compartment wherein ignition of the air-fuel mixture occurs.

The compressor and power sections each comprises a fixed housing having therein a cylindrical chamber sealably enclosed. The compressor chamber is sealably enclosed with a front cover plate and a forward wall of a central cover plate, and the power section is sealably enclosed with a rear cover plate and a rear wall of the central cover plate. The cover plates have drive shaft through-holes therein located eccentrically with respect to the chamber walls, said through-holes having therein sealably enclosed sealed drive shaft bearings. Movable vane rotor assemblies are rotatably mounted within each chamber, each said assembly comprising a hollow cylindrical rotor having an outer diameter smaller than the chamber curved surface diameter in which the assembly is mounted and an inner diameter larger than the chamber radius in which the rotor is mounted. Each rotor has a floating vane assembly associated therewith comprising a plurality of three or more vanes rotatably connected to a floating shaft, said shaft being enclosed within a hollow interior of said rotor and being centrally oriented with respect to the cylindrical chamber internal curved surface. Each of the vanes extends sealably through a rotor vane aperture, one aperture for each vane, said apertures being disposed equidistantly from adjacent apertures and being disposed circumferentially around the outer curved surface of the rotor shell. The vanes are sealably movable within said apertures which are axially pivotable within said rotor shell. Vane lengths from floating shaft center position to vane ends are substantially equal to the chamber radius, and the vanes have widths substantially equal to the width of the chamber wherein the rotor vane assembly is mounted. The vanes are further enclosed within the rotor by forward and central rotor end-plates.

The rotors are mounted eccentrically within the chambers and the vanes movably and sealably abut against chamber inner surfaces, with the vanes having vane seal members mounted on the ends and side edges thereof. Drive shafts are fixedly connected to outer and inner rotor end-plates on outer surfaces thereof and extend through drive shaft through-hole bearings in chamber cover plates. The compressor and power section central drive shafts are splined together for joint rotation. Drive shafts connected to rotor outer end-plates are for power transmission. The outer power transmission drive shafts, the cover plate bearings, the drive shaft bearing through-holes and the compressor and power section central drive shafts and bearings are provided with lubricating oil injection means.

A compressor air intake port is located partially in a second quadrant and partially in a third quandrant of the compressor chamber, said quadrant numbering beginning at a rotor to chamber tangency point with numbers increasing in the direction of rotor rotation. A compressor air exhaust port is located in the fourth quadrant thereof. This quadrant nomenclature is the same for both the compressor and power engine sections. The compressor exhaust port is ducted to a power section air intake port disposed partially in a last half of a power section fourth quadrant and partially in a first half of a power section first quadrant. A fuel injection port and a fuel air mixture igniter means are located in the power section first quadrant forwardly disposed in the direction of rotation from a forward air intake port wall, said igniter being forwardly disposed relative to the fuel injection port. A power exhaust port is located so as to include the last half, more or less, of a power section third quadrant and a first half, more or less, of a power section fourth quadrant so as not to overlap the air intake port.

The engine is provided with requisite auxiliary means for fuel injection fuel flow regulation, engine lubrication, fuel ignition control, air intake filtering, engine exhaust cleaning, engine starting, electrical power generation, and engine cooling which are more fully described hereafter.

In addition to providing an engine as heretofore described, it is an object of the invention to provide a rotary internal combustion engine:

Having continuous combustion of an air-fuel mixture thereby eliminating the need for continuous timing spark to ignite said mixture;

Employing fewer moving parts than the conventional piston engines currently used in most automotive applications;

Having an efficient cooling means;

Wherein a relatively high torque is attainable even at low rotational velocites of the rotor assembly;

Having provisions for economical lubrication wherein the amount of lubricant required is significantly reduced compared with that required in the conventional piston engine used for automotive purposes;

Having few moving parts, being substantially free of vibration during operation, yet being simple and economical to construct;

Having significantly increased power to size and weight ratios compared to conventional piston engines;

Wherein abutment of each vane seal against the chamber walls is positively effected and yet vane seal to chamber forces are minimized;

Wherein the compression ratio may be varied by metering the amount of air delivered from the compressor section to the power section and at the same time metering the fuel injected into the power section at the fuel injection port;

Wherein most grades of liquid fuels may be used, such as diesel fuel, low octane gasoline, high octane gasoline, kerosene, and the like, Having a relatively low rotating mass thereby providing acceleration and deceleration more rapid than presently used piston engines and rotary engines.

These and other objections of the invention will be apparent to those persons skilled in the art as the description proceeds in particular reference to the application drawings.

BRIEF DESCRIPTION OF THE APPLICATION DRAWINGS

FIG. 1 is a perspective view of a rotary engine embodying the invention herein, viewed at an angle looking toward the power section rear cover plate and showing, among other engine components, the power section exhaust thermal reactor and compressor air intake filter means.

FIG. 2 is a perspective view looking at the compressor section front cover plate and the side showing, among other engine components, the alternator beside the finned compressor section, the compressor air duct atop and to the side of the compressor section, the fuel regulator valve means on the power section side and therebelow an oil filter means.

FIG. 3 is a cross-sectional view of FIG. 2 taken along line 3—3 of FIG. 2, showing the internal construction of the compressor and power sections.

FIG. 3A is an enlarged cross-sectional view comprising inset 3A of FIG. 3.

FIG. 4 is a cross-sectional view of the compressor section shown in FIGS. 2 and 3 taken along line 4—4 of FIG. 3 showing the constructional features of the movable vane rotor assembly and its orientation within the compressor section chamber.

FIG. 5 is a cross-sectional view taken along line 5—5 of FIG. 3 showing constructional features of the power section movable vane rotor assembly and the orientation thereof with respect to the power section chamber.

FIG. 6 is a longitudinal cross-sectional view of a power rotor segment taken along line 6—6 of FIG. 5.

FIG. 7 is a fragmented plan view of a power section rotor segment taken on line 7—7 of FIG. 6.

FIG. 8 is a cross-sectional view of a power section rotor segment taken along line 8—8 of FIG. 6.

FIG. 9 is a cross-sectional view of the compressor section vane rotor bearing showing the manner in which the vane is sealably inwardly and outwardly movable in the rotor aperture.

FIG. 9A is a cross-sectional view of a power section rotor vane bearing.

FIG. 10 is a longitudinal fragmented view of a vane rotor bearing taken along line 10–10 of FIG. 9, showing the spring means used to maintain vane to bearing aperture contact.

FIG. 11 is a cross-sectional view of a vane sectioned along line 11—11 of FIG. 5, showing the construction of the vane seals.

FIG. 12 is a side view of a vane seal and floating shaft connecting end.

FIG. 13 is a fragmented cross-sectional view along line 13—13 of FIG. 11.

FIG. 14 is a top plan view of the vane.

FIG. 15 is a plan view of a chamber port, showing typical port construction.

FIG. 16 is a schematic cross-sectional view of a fuel regulator valve means, sowing a needle valve in combination with a rotary flow-control valve.

FIG. 17 is a plan view of the cylindrical surface of the rotary flow control valve.

FIG. 18 is a cross-sectional, schematic view of the manifold oil injection valve.

FIG. 19 is a fragmentary view of the air filter means outlet manifold, showing the injecting of oil into the manifold during engine startup.

FIG. 20 is a partial fragmentary view of the oil pump, fuel pump, cooling fluid pump, alternator, and starter motor drive housing, showing the drive means from the shaft connected to a cooling fluid pump drive means.

FIG. 21 is a cross-sectional view of the fuel injection means valve shown in FIG. 5.

FIG. 22 is a fragmentary, perspective view of the exhaust thermal reactor, also showing the compressed air duct connection and the location of the thermal transfer means for conducting heat to the air filter choke means.

FIG. 23 is a cross-sectional view taken along lines 23—23 of FIG. 22, showing the arrangement of the heat exchanger fins of the thermal reactor.

DETAILED DESCRIPTION OF THE PREFERRED EMBODIMENTS

A preferred embodiment of a rotary internal combustion engine of the present invention is illustrated in the accompanying drawings and is identified generally by the reference character 10 (FIGS. 1 and 2). Constructional details are shown generally in FIGS. 3–23.

The illustrated embodiment of the rotary internal combustion engine 10 herein comprises in combination a compressor section 11, a power section 12, and component parts and sub-components therefor found generally in automotive engines, said compnent parts being auxiliary to said compressor and power sections. The said component parts and sub-component parts thereto are described below.

An air intake filter means 13 has connected thereto an air inlet 14 having an automatic thermally operated choke means 15 controllably connected thereto, said air filter means 13 having an air outlet manifold 16 having an air outlet 17 sealably connected to an air intake port 18 of said compressor section 11. The manifold 16 has mounted thereon an oil metering oil injection valve means 19 (FIGS. 18 and 19) to provide controlled injection of oil through an oil outlet duct 20 thereof, the outlet duct 20 being ducted to an oil injection nozzle 21 (FIG. 19). The duct 20 passes through a wall 22 of the manifold 16 and is connected to nozzle 21, the valve means 19 having an oil inlet duct 23 sealably ducted to a rotary oil pump means 24 (described below).

The oil metering oil injection valve means 19 (FIG. 18) comprises, in combination, a right solenoid winding 25, a left solenoid winding 26, magnetically permeable control rod 27, inserted through the hollow interior of said windings. The rod 27 has centrally located thereon a protruding triangularly shaped member 28 generally in the form of a solid right triangle, the hypotenuse 29 thereof being in slidable abutment with a spring loaded needle 30 mounted slidably and sealably in a needle cavity 31 in a valve block 32, said valve block 32 having an oil flow through-hole 33 therein sealably connected at a left end 34 to said oil inlet duct 23 and at a right end 35 to said oil outlet duct 20. The needle cavity 31 communicates with the oil flow through-hole 33 and has spring means 36 therein which maintains said needle 30 in an extended postion (valve open) with respect to a valve seat portion 37 of said needle cavity 31. The cavity extends through the oil through-hole 33 and has the valve seat portion located on an under side of said through-hole 33, the valve block 32 further having therein intermediate said left end 34 and said needle cavity 31 an oil flow limiting means 38 comprising a threaded needle 39 inserted into a threaded cavity 40 in said valve block 32 and extending through said oil through-hole 33. The threaded needle 39 is screwable into and out of the threaded cavity 40, and upon being screwed into said cavity, closes off partially or completely, depending upon the depth to which it is screwed, said oil through-hole 33. The oil injection valve means 19 controls the flow of oil into said manifold 16 and is generally in an open position when the engine ignition switch (not shown) is turned to an off position and during engine start-up when said switch is turned to a start position.

When the ignition switch is turned to a run position, the valve means 19 is in a closed position and no oil flows therethrough. Operating the ignition switch as set forth above energizes the appropriate solenoid winding causing the permeable control rod to move right or left. In the configuration shown, when the left winding is energized the valve is closed, and when the right solenoid is energized, the valve is opened. FIG. 18 shows the valve means in the open position - engine off and start-up positions.

A cooling fluid pump means 41 (FIGS. 2 and 20) is operably connected to a compressor section auxiliary power drive shaft 42 (FIG. 2) which is operably connected to an auxiliary drive means 43, (FIG. 20), which may be either a belt or chain means. The auxiliary drive means 43 is further operably connected to a rotary oil pump drive means 44 (the pump means is described below), a fuel pump drive means 45 (the fuel pump means is described below), and an electrical power generator drive means 46. The auxiliary drive means may in the alternative be driven by an electrically actuated starter means 47 to start the engine, the pump means 41 having an extension of said auxiliary power drive shaft 42 sealably extending through a front plate 48 of a pump housing 49 which sealably encloses the fluid pump means 41 and being fixedly connected to an attachment face 51 of the cover plate 50 and to an accessory chain drive housing 52, the housing 52 being integral with a forward engine mount 53. The cooling fluid pump means has a cooling fan drive shaft 54 extending forwardly sealably and rotationally therefrom and having fixedly connected thereto an attachment flange 55 for fixedly connecting a cooling fan (not shown) thereto. The cooling fluid housing 49 has sealably attached thereto a fluid inlet duct 56 for sealably ducting water from a cooling radiator (not shown) to the fluid pump 41, the fluid pump housing further having a fluid outlet duct 57 sealably connected to the pump housing 49 for sealably ducting cooling fluid to a power section fluid inlet duct 58 located in a central compressor section cover plate 59, such central cover plate in combination with a power section housing 199 and a power section rear cover plate 203 sealably encloses a power section cooling fluid chamber 60 and further sealably encloses a power cylinder chamber 61 and a compressor cylindrical chamber 62 (FIGS. 3, 4, and 5 for details). The cooling fluid chamber 60 is sealably separated from the cylindrical power chamber 61 and the compressor cylindrical chamber 62, said cooling fluid chamber being enclosed within the central covere plate 59 and further enclosed by a power section outer housing wall 63, an inner wall 201, a front wall 206 and a back wall 207. The power section outer wall 63 has therein a cooling fluid outlet duct 64 (see FIG. 1) for sealably ducting fluid to a cooling radiator (not shown). The power section housing wall 63 further has therein centrally located in a top portion 65 thereof (see FIG. 1) an auxiliary heater feed duct 66 for sealably ducting hot fluid to an auxiliary heater (not shown), the feed duct 66 being ultimately returned to the power section fluid outlet duct 64 via a heater outlet return duct (not shown).

A rotary oil pump means 24 (see FIGS. 1 and 2) having an oil inlet duct 67 sealably ducted to an oil sump 68 has a plurality of outlet ducts 69 for sealably ducting oil to an oil filter inlet 70 integral with an oil filter means 71 having an oil outlet 72 sealably ducted to the sump 68, to the injection valve means oil inlet duct 23, (FIGS. 2 and 19), to a compressor oil injection inlet duct 73, (See FIG. 3) and to a power section oil injection inlet duct 74. The oil pump means 24 has a pressure regulating by-pass valve means 75 integral with said pump means 24, comprising a spring loaded ball valve means interposed between said outlet and inlet ducts.

A rotary fuel pump means 76 (see FIG. 2) has a fuel pressure regulating by-pass valve means 77 integral therewith and further has a fuel outlet duct 78 sealably ducted to a fuel inlet 79 of a fuel injection regulator valve means 80. The latter comprises in combination an electrically actuated on-off flow valve means 81 and a manually operated rotary fuel flow control valve 82 for engine speed control, the on-off flow valve means 81 completely stopping the flow of fuel when the aforesaid ignition switch means (not shown) is turned to an off position. The fuel injection regulator valve means 80 has a fuel outlet duct 83 sealably ducted to a fuel injection control nozzle 84 (shown in FIGS. 5 and 21) having a nozzle opening 85 which may be varied by needle valve means 86.

A compressed air duct 87 (see FIG. 2) is provided for sealably ducting compressed air from a compressor section exhaust port 88 (see FIG. 4), the port 88 comprising a flanged port opening 89 having axially disposed slot openings 90 (see FIG. 15 for typical configuration) in compressor section housing 91, the openings extending around the periphery of the housing, an area covering about one-eighth of the said peripheral area being in the latter half of a fourth quadrant of said compressor section as described before, the quadrant numbering beginning at a point of rotor to chamber tangency and increasing in the direction of rotor rotation. The air duct 87 ducts compressed air to a power section air intake port 92 (see FIG. 5), comprising a flanged air intake port opening 94 having axially disposed slot openings 90, the intake port being similar in construction to the air exhaust port 88. The slots 90 are located partially in the latter half of the fourth quadrant and partially in the first half of the first quadrant of said power section housing 199, the duct 87 being fixedly and sealably connected to the compressor air exhaust flanged port opening 89 and the power air intake port opening 94 and having therein an auxiliary air outlet duct 95 (see FIG. 2) sealably ducted to a thermal exhaust gas reactor 96 to be described below. The auxiliary air outlet duct 95 has therein a pressure regulating and control valve means 97.

The thermal exhaust gas reactor 96 (shown in FIGS. 1, 2, 22 and 23) is provided with a plurality of fixed heat exchange fins 98 which extend into the flow path of hot engine exhaust gases and provide reactive surface means whereby the hot gases and compressed air ducted from the compressor through the auxiliary air outlet duct 95 into said thermal reactor 96 may more efficiently react to reduce unwanted exhaust emissions. The reactor 96 further has a heat transfer means 98A connected thereto ducted to the automatic thermally operated choke means 15 on the air intake filter means 13 to provide thermal energy to operate said choke means.

An ignition voltage regulator means 99 is provided (shown in FIG. 2) of the type having a resistive element which provides for a reduction of ignition current at output terminals 100 thereof after start-up of the engine. The regulator means has input terminals 101 electrically connected by insulated conductive wire leads 102 to output terminals (not shown) of the electrical power generator 46, the output terminals being electrically connected by insulated conductive wire to one or more fuel-air mixture igniters 103 shown in FIG. 5), of the standard glow plug type having an extended threaded portion 104.

An oil sump 68 (see FIGS. 1 and 2), described hereinabove in connection with the oil pump means 24, is mounted below the compressor and power sections and is fixedly connected to a front engine mount 53 by bolt means, said sump having an oil addition duct 105 sealably connected to said sump 69 at inlet end 106 and having an oil duct inlet cover 107 at an oil inlet addition end 108. The duct has an oil vapor exhaust duct 109 intermediate said ends sealably ducted to an oil vapor exhaust inlet duct 110 sealably ducted into a filter means cartridge chamber internal to said air intake filter means 13 and being of a standard design and construction.

Reference is now made to FIGS. 3–16 in which the major component parts, the compressor section 11 and the power section 12 of the rotary internal combustion engine of the invention herein are illustrated. The two sections are mounted in tandem (see FIG. 3) utilizing any conventional acceptable mounting method. The rear engine mount (not shown) could utilize a conventional transmission means mount. The two sections have substantially similar moving vane rotor assemblies, the moving vane rotor assembly of the compressor section being designated by the number 112 and the moving vane rotor assembly of the power section being designated by the number 234. Each of the moving vane rotor assemblies may have minor functional changes coincidental with particular functions of the applicable engine section.

The compressor section 11 of the preferred embodiment comprises a cylindrical housing 113 having on an outer surface 114 of a circular wall 115 thereof radial cooling fins 116 disposed axially along said outer surface and extending outwardly therefrom, an inner surface 117 of said circular wall circumscribing a compressor cylindrical chamber 62. A compressor housing front cover plate 50 includes a forward end-plate 118, the front surface of which comprises an accessory face plate 51. The front cover plate has a drive shaft bearing circular through-hole 119 therein eccentrically oriented with respect to a periphery of said compressor chamber forward end-plate 118 and extending therefrom through said accessory face plate 51 of said cover plate 50. The bearing through-hole 119 has sealably enclosed therein a drive shaft bearing means 120, the through-hole 119 being defined by a wall 121 circumscribing said through-hole 119, the upper portion 122 of said wall 121 receiving the extension 123 of an oil inlet duct 73 to permit oil injection thereinto, the rotor bearing means 120 has a bearing oil through-hole 124 to permit oil injection into and through the bearing means 120, the through-hole 124 further communicating with a drive shaft through-hole 126 which in turn communicates with the hollow interior 127 of the rotor to permit lubricating oil injection thereinto.

The compressor front cover plate 50 is circular and has a flange portion 128 extending outwardly from the periphery of said end-plate 118 to a cover plate peripheral portion 129, the flange mating with a forward face 130 of the compressor housing 113. The flange portion 128 has arcuately disposed thereon a plurality of compressor section stud bolt through-holes 131 disposed in mating position with respect to compressor housing stud bolt through-holes 132 extending axially through the fins 116 of said housing and through the flange portion 128. The holes 132 are matingly disposed with respect to a plurality of threaded openings 134 in a front flange portion 135 of a central cover plate 59, the stud bolt through-holes having inserted therein and threaded into said opening a plurality of compressor section stud bolts 136, one for each of the said stud bolt through-holes, for detachably connecting said compressor front cover plate 50 and said compressor housing 113 to said central cover plate 59 thereby forming the compressor cylindrical chamber 62.

The central cover plate 59 has a lower front surface portion 137 having a periphery 138 thereof which mates position with the adjacent portion of the compressor housing, the cover plate 59 further including a rear surface end-plate 139 and a flange portion 140, the rear surface portions being described more fully below in conjunction with the power section 12. The central cover plate 59 has a compressor rotor drive shaft through-hole 141 therein eccentrically oriented with respect to the periphery of the central end plate 137 and with respect to the compressor cylindrical chamber, the drive shaft bearing through-hole 141 having sealably enclosed therein a drive shaft bearing means 142 and having rotationally fixedly inserted therein a compressor rotor drive shaft 174. The drive shaft 174 extends about one-half the axial distance into the bearing means 142, the central rotational axis 144 of said drive shaft 174 being in axial alignment with the rotational axis 145 of the central rotor drive shaft. The compressor housing 113 has located therein partially in a first quadrant thereof and partially in a second quadrant thereof a compressor section air intake port 18 comprising a plurality of axially disposed arcuate slots 90 (see FIG. 15) extending from a housing outer surface) 146 into the compressor cylindrical chamber 62. Extending axially across said housing surface and peripheral thereto is an air outlet manifold mounting flange 147, the air intake filter means 13 and air outlet manifold 16 having been earlier described. The compressor housing further has a compressed air exhaust port 88 located in a last half of a compressor housing fourth quadrant, constructed substantially in like manner to the said air intake port 18 except for the dimensions thereof.

A compressor section movable vane rotor assembly 112 is rotatably mounted in the compressor cylindrical chamber 62, the assembly comprising a hollow cylindrical rotor 148 having an outer diameter $D_{ro}$ (FIG. 3) smaller than a compressor chamber diameter $D_c$ and having an inner diameter $D_{ri}$ larger than said compressor chamber radius $R_c$, thus defining a hollow cylindrical shell 148 enclosing said compressor rotor hollow interior 127. The rotor has a compressor section floating vane assembly 149 comprising a plurality of three or more vanes 150 (the embodiment herein described has six vanes) pivotally connected to a compressor floating vane shaft 151, the shaft being enclosed within the rotor hollow interior 127. Each of the vanes 150 extends sealably through a compressor rotor vane aperture 152, there being one aperture for each vane. The rotor vane apertures 152 are disposed circumferentially around the rotor shell 148, the vanes being sealed and inwardly and outwardly movable therein. The apertures are axially pivotably movable within the rotor shell. Each compressor rotor vane aperture is axially positioned between a front D-shaped half bearing member 153 and a rear D-shaped half bearing member 154 of a rotor vane aperture enclosing bearing 155 (See FIGS. 4, 9 and 10), each aperture being defined by vertical surfaces 156 thereof, the vertical surfaces 156 further acting as vane seal and vane bearing surfaces. Half cylindrical surfaces 157 of the D-shaped half bearing members sealably abut against rotor segment curved surfaces 158 adjacent thereto. Reference is made to FIGS. 6, 7 and 8 which show rotor segments having a portion of an outer cylindrical surface 160 thereof removed but otherwise illustrating the compressor section rotor segments 161.

Referring to FIG. 9, the rear bearing member vertical surface 162 has an elongate axially oriented channel 163 therein, said channel optimizing the vane abutting bearing surface to reduce frictional forces therebetween while maintaining a seal therebetween during operation of the engine. The front D-shaped half bearing member 153 has a front member 164 having a plurality of elongate axially oriented rectangular shaped ribs 165 on a rear face thereof and an elongate axially and centrally oriented rectangular slot 166 formed between two adjacent ribs. The ribs and slot mate with slots 167 formed in rear member 168 of the front D-shaped half bearing member. A wave spring means 169 is mounted in the slot 166 for providing force against the front and rear members thereby forcing said vane aperture in bearing and sealable abutment with a vane 150 inserted within the aperture.

The compressor rotor comprises in part a plurality of the above described rotor vane aperture bearings 155 and a plurality of rotor segments 161 distributed equidistantly in alternate arrangement circumferentially around the rotor shell 148, and further comprises an outer rotor end-plate 170 (see FIGS. 3 and 6) having centrally and axially fixedly connected with an outer surface 171 thereof a compressor rotor auxiliary drive shaft 42. The latter extends axially in sealed relation through the compressor rotor bearing means 120, the drive shaft having oil flow through-hole 126 as described above. An inner compressor rotor end-plate 172 has centrally and axially fixed thereto on an outer surface 173 thereof a compressor rotor drive shaft 174 rotationally fixedly inserted into said central rotor drive shaft bearing means 142, extending axially less than half-way thereinto. The compressor rotor drive shaft 174 has an oil through-hole 175 therein communicating with the interior 127 of the rotor for providing lubricating oil flow to the bearing surfaces and bearings within the central cover plate and the bearing surfaces between the end-plate 172 and the surface 176 of the end-plate.

The rotor segments 161 and bearings 155 are disposed in alternate arrangement around the rotor shell as aforesaid. The rotor segments are fixedly and detachably connected at outer ends 177 thereof to the outer rotor end-plate 170 and at inner ends 178 thereof to the inner rotor end-plate 172 by bolt means 179. The rotor is rotatably mounted within the compressor cylindrical chamber 62, as aforesaid, being eccentrically and axially oriented therein and forming a point of tangency 180 with the inner surface of the chamber wall, there being a relatively small distance separating the rotor outer surface and the inner chamber surface at the point of tangency 180. The outer rotor end-plate 170 fits in sealed relation into a forward end-plate recess 181 and the inner rotor end-plate fits sealably into a compressor central end-plate recess 182. The outer rotor segment ends are in alignment with and parallel to the inner and outer rotor end-plates and the compressor end-plates.

Referring now to FIGS. 3, 4, 9 and 10, and more particularly to FIGS. 11, 12, 13, and 14, the compressor section vane assembly 149 of the movable vane rotor assembly 112 comprises a plurality of three or more (herein six) vanes 150 connected to a compresor floating vane shaft 151, said shaft being enclosed within the compresor rotor interior 127 and being centrally oriented with resect to the inner curved surface 117 of the housing. Each of the vanes extends sealably through the rotor vane apertures 152 and is inwardly and outwardly movable therein, the vane apertures being axially pivotably movable in the rotor shell 148. The six vanes 150 in the preferred embodiment herein described are designated by letters A, B, C, D, E, and F in FIGS. 4 and 11. Each of the vanes are substantially identical except for the orientation of pivot bearing means 183 thereon. This orientation is shown in FIG. 11 (A through F), and is arranged to permit all six vanes to pivot on a single floating vane shaft 151.

Vane lengths $L_v$ measured from a center 184 of the bearing through-hole 185 to the abutment end 186 thereof are substantially equal to each other and to the compressor chamber radius $R_c$ (See FIG. 3). The vane widths $W_v$ (see FIGS. 11 and 14) are substantially equal to a compressor chamber width $W_c$ (see FIG. 3) measured between the chamber forward end-plate 118 and the compressor central end-plate 137. Each vane has a lower edge 187 clearingly disposed with respect to the vane pivot bearing means 183 when floating shaft 151 is inserted into the shaft through-hole 185 thereof, a vertical abutment edge 188, a vertical abutment edge 189 and a top abutment edge 190.

Each of the edges, excepting the said lower vane edge 187, has vane to chamber seal means comprising two L-shaped seal members 191 inserted slidably and sealably into a mating vane edge channel 192 in each of said vane edges. The L-shaped seal members 191 are joined slidably and sealably in a central portion 193 (FIG. 14) of the abutment edge 190 in movable relationship to each other, with one L-shaped member being located within the forward end-plate abutment edge and partially in the curved surface abutment edge, and the other L-shaped member being located in the central end-plate abutment edge and partially in the abutment edge adjacent thereto. The centrally joined portion 193 of the L-shaped members comprises right angle off-set mating surfaces 194 (see FIG. 14). Inserted at corners of the channels are right angle wave spring means 195 interposed between lower surfaces 196 and a mating channel surface 197, the wave spring means maintaining an outward force against the L-shaped members with respect to the vane channel mating surface. A lower end 198 of each of the vertical channels has an oil flow opening therein for providing an oil flow path through the channel from the interior 127 of the rotor. (See FIGS. 11, 12 and 13).

The power section 12 of the preferred embodiment herein described has provisions for fluid cooling means. Referring to FIGS. 3, 3A and 5, the power section 12 comprises a cylindrical chamber housing 199 having a plurality of cooling fluid flow-through compartments 200 being axially oriented with respect to the housing and circumferentially spaced around said housing, and being interior to a housing outer wall 63 and exterior to wall 201, the inner wall 201 having an inner curved surface 202 circumscribing a cylindrical chamber 61. A power section rear cover plate 203 has a front end-plate 204 and a back face plate 205, the rear cover plate 203 having a front wall 206 and a back wall 207 and having therebetween a cooling fluid flow-through cavity 208. A cooling fluid flow path is thus formed between the housing compartments 200, rear cover plate cavity 208, central cooling fluid chamber 60, fluid inlet duct 58 and the cooling fluid outlet duct 64. The power section housing 63 has a seal face means 208A matingly and sealably abutting seal face means 209, the chamber housing 63 further having peripheral seal face means 210 matingly and sealably abutting with a rear seal face means 211. Each of the seal face means comprises a centrally located groove 212 (FIG. 3A) axially aligned with a groove 213 in a mating seal face, the mating faces 214 having therebetween a seal gasket means 215 constructed of any of the class of materials normally employed for high temperature compression seals. The rear cover plate 203 has a plurality of stud bolt through holes 236 which are in axial alignment with the cooling fluid flow-through compartments 200 and are disposed with respect to a plurality of threaded cavities 216 in the portion 140 of the central cover plate 59. The latter has a rear end-plate 139 in mating position with the power chamber curved surface 202, the stud bolt through-holes 215 receiving a plurality of stud bolts 217 therethrough and screwed into the threaded cavities 216, one stud bolt for each cavity, for detachably connecting the rear cover plate 203 and the housing 63 to the central cover plate 59 thereby sealably enclosing and forming therewith the cylindrical chamber 61.

A movable vane rotor assembly 234 is constructed substantially identically to the above described compressor vane rotor assembly as shown in FIGS. 3–13. One minor difference is that rotor segments of the power section rotor in the embodiment described herein each have a groove 235 in a curved outer surface thereof as shown in FIGS. 6–8 for increasing the volume of compartments defined by adjacent vanes, the rotor outer surface, power chamber surfaces and rotor curved surfaces therebetween. The bearing 225 has a front D-shaped portion 226 having a vertical surface 227 formed with an elongate axially oriented channel 228 therein, and the rear D-shaped member is identical to the D-shaped member 154 previously described. Thus, the solid D-shaped portion will be adjacent to the vane side 230 opposite the side to which pressure from the expanding fuel air mixture is applied in the power section. In the compressor section the forces acting upon the vanes are applied to opposite sides of the vanes from that in the power section.

The central cover plate has between a front wall 218 and a back wall 219 thereof cooling fluid chamber 60 opening into the cooling fluid flow-through compartments 200 in the section housing 199. The central cover plate has a through-hole 141 as above described. Bearing means 142, enclosed therein and described earlier for the compressor section, services a power section drive shaft 220 rotationally fixedly inserted into the bearing means and extending less than half way thereinto. The power section drive shaft and power rotor 221 to which said drive shaft 220 is fixely connected is in axial alignment with the compressor central rotor drive shaft 174 and compressor rotor 148. Similarly, the rear power cover plate 203 has a bearing means 222 therein aligned eccentrically with respect to the power chamber 61 and having a power transmission drive shaft 223 rotationally inserted through the bearing means to provide rotational drive force to a transmission means (not shown). The rear face plate 203, the power drive shaft 223, the drive shaft bearing means 222, and the peripheral wall 224 in the cover plate 203 have lubricating oil through-hole means as described and illustrated with regard to the compressor through-hole oil injection means. Fuel injection means and fuel-air igniter means are provided as shown in FIG. 5 and described earlier herein.

The power section housing has an air intake port 92 described heretofore, and also has an exhaust port 231 of similar construction to that of the compressor air intake port 18 except that the power section exhaust port 231 is located partially in the third and fourth quadrants of the power section housing, said exhaust port having a flanged wall 232 around the periphery of said exhaust port which has sealably bolted thereto a thermal exhaust reactor 95, described earlier.

The compressor rotor point of tangency 180 is disposed approximately 180° from that of the power rotor point of tangency 233 for the embodiment described herein. However, the relative orientation of tangency points is not critical and any convenient orientation can be employed.

Materials of construction may be chosen from those commonly used in the automotive industry for construction of enginines and engine parts.

The engine operation relies on the ignition of an air-fuel mixture in the power section compartment in approximately the first half of the first quadrant of the power chamber, air having been delivered by the compressor section. Ignition causes the compressed air-fuel mixture to expand creating a greater force against the forward vane, since this vane presents the greater area to the expanding fuel-air mixture than does the following vane, thus causing the moving rotor assembly to rotate. The auxiliary equipment drive may be either a chain or a standard V belt drive or other means. When the V belt is used, lubrication of the auxiliary drive means within the accessory drive housing is unnecessary. The exact chamber porting, porting areas, porting locations, as well as locations of the fuel injector or injectors and igniter or igniters (glow plugs for example) will depend upon the particular engine design and the desired engine characteristics and engine use. In the preferred embodiment, the starter is connected to the accessory drive means through a one-way frictional engagement unit such as the commerical "Sprag" mechanism and the starter armature does not rotate except during engine start-up, while it is energized.

The preferred embodiment uses six rotor vanes which is the number recommended for maximum engine life and optimum operation. Although in the preferred embodiment described the compressor section is air cooled and the power section is fluid cooled, either or both may be air cooled or water cooled, depending upon the amount of cooling required for the application. However, generally the embodiment shown is the preferred arrangement.

The engine is adaptable to diesel operation, and for some configurations the igniters may be shut off after startup because combustion of the hot compressed gases will continue without external ignition means.

While the invention is illustrated and described in a preferred embodiment herein, modifications and variations may be effected without departing from the scope of the novel concepts described and as set forth more fully in the claims appended hereto.

I claim as my invention:

1. A rotary internal combustion engine comprising:

a. an air compressor section having a cylindrical compressor chamber, and a power section having a cylindrical power chamber, each of said compressor and power chambers having separately disposed therein:

1. a rotor shell mounted eccentrically in said chamber,

2. a floating vane assembly comprising a floating shaft and a plurality of vanes pivotally connected to said shaft and spaced circumferentially therearound, each vane extending through means defining a vane aperture in said rotor, the axis of each floating shaft being generally concentric with the axis of the respective chamber in which it is positioned but not securely mounted therein so as to permit limited movement of said shaft in directions parallel and radial to the axis of rotation of said rotor, constrained only by the engagement of the ends of said vanes with said chambers, b. means for coupling said rotor shells for simultaneous rotation;

c. air inlet means communicating with said compressor chamber, and means for directing the compressed air from said compressor chamber to said power chamber;

d. means for delivering fuel to said power chamber for mixture with said compressed air, and e. igniter means communicating with the interior of said power chamber for igniting said fuel-air mixture, whereby said rotor in said power chamber provides rotational drive force.

2. The rotary engine of claim 1 wherein said coupling means comprises a compressor drive shaft aligned with and coupled to a shaft extending from the adjacent end of said power section whereby both of said rotors rotate in the same direction at the same speed.

3. The rotary engine of claim 1 further including air intake filter means mounted adjacent to said compressor chamber, said filter means having connected thereto an automatic air inlet choke means, and an air outlet manifold mounted between said filter means and said air inlet means to compressor chamber an oil metering injection valve means mounted on, said manifold to provide controlled injection of lubricating oil into said manifold during engine start-up thereby providing lubricating for the compressor for parts internal to the compressor cylindrical chamber during engine start-up.

4. The rotary engine of claim 1 further including means for cooling said compressor and power chambers.

5. The rotary engine of claim 4 wherein said means for cooling said compressor chamber comprises radial cooling fins on the exterior of said compressor chamber.

6. The rotary engine of claim 4 wherein said cooling means for said power chamber comprises a fluid coolant compartment surrounding said power chamber and sealably separated therefrom.

7. The rotary engine of claim 6 wherein said power chamber is enclosed by a central cover and a rear cover plate exterior of which are further fluid coolant compartments, said compartments being interconnected with each other and having inlet and outlet duct means sealably interconnected with said compartments, and coolant pump means driven by said means for driving said compressor rotor, said pump means being sealably ducted to said inlet duct means, said outlet duct means being sealably ducted to a heat exchanger means sealably ducted to said inlet duct means.

8. The rotary engine of claim 7 wherein said compressor chamber is enclosed by a central cover plate which, together with the central cover plate of said power chamber are constructed as an integral central cover plate having an opening in which is mounted bearing means, compressor rotor drive shaft being mounted in a forward end of said bearing means and a power section rotor drive shaft being rotationally mounted in a rearward end of said bearing means, said integral central cover plate having a fluid coolant flow-through chamber therein.

9. The rotary engine of claim 1 wherein said vanes are formed with abutment edges in which are mounted seal means comprising two L-shaped seal members inserted slidably and sealably into a mating vane channel formed in said abutment edges, said L-shaped seal members being joined slidably and sealably in a central portion of said surface abutment edge of said vanes by right angle off-set matingly joining surfaces of said L-shaped members, said L-shaped seal members being forced into sealable abutment with the surfaces of said chambers by spring means interposed between said L-shaped members and said channels, said spring means maintaining an outward force against said L-shaped seal members with respect to said channels, said channels further providing a lubricating oil flow-through path communicating with an interior portion of the hollow cylindrical rotor.

10. The rotary engine of claim 1 further including bearing means defining each vane aperture, said bearing means comprising a front D-shaped half bearing member and a rear D-shaped half bearing member, said aperture being defined by vertical surfaces of said D-shaped half bearing members, said vertical surfaces further acting as vane seal and vane bearing surfaces, the half cylindrical surfaces of said D-shaped half bearing members abutting against rotor segments adjacent thereto, said rear D-shaped half bearing member having in the vertical surface thereof an elongate axially oriented channel therein, said front D-shaped half bearing member including a front section having a plurality of elongate axially oriented rectangular shaped ribs on the rear face thereof and having an elongate axially and centrally oriented rectangular slot therein, said slot and rear face ribs being matingly oriented and inserted into slots formed on a front face of a rear section of said front D-shaped half bearing member, there being located within said central slots a wave spring means for providing force against said front and rear members thereby forcing said front member in bearing and sealable abutment with a vane inserted within said aperture, said rear D-shaped member abutting the vane side opposite the direction of rotation of said vanes in the power chamber.

11. The rotary engine of claim 1 wherein said rotor comprises alternately disposed rotor segments and rotor vane apertures disposed circumferentially forming a cylindrical rotor shell having said apertures therein, said rotor segments being fixedly and detachably connected at the outer ends thereof to an outer rotor end-plate and at the inner ends thereof to an inner rotor end-plate, said rotor segments having therebetween in axial alignment therewith rotor vane bearings having two half cylindrical members having curved surfaces abutting adjacent rotor segment curved surfaces and having vertical surfaces thereof forming vertical walls of said rotor vane apertures, said rotor curved surfaces being of sufficient arc length to hold said half cylindrical members in place within said rotor shell when vanes are inserted in said apertures.

12. The rotary engine of claim 1 further including a rotary fuel pump provided with a pressure regulating by-pass valve means between inlet and outlet ducts thereof, said pump pumping fuel to a fuel flow regulator valve means.

13. The rotary engine of claim 12 wherein said fuel flow regulator valve means comprises in combination an electrically actuated on-off valve means for stopping fuel flow when electrically de-energized and a manually operated rotary fuel flow control valve for manual speed control of said engine.

14. The rotary engine of claim 1 further including exhaust duct means communicating with said power chamber, said exhaust duct means comprising a thermal exhaust reactor means and an exhaust conduit exiting therefrom, said thermal exhaust reactor comprising an exhaust reaction chamber connected to an exhaust port flange having in said reaction chamber a plurality of fixed heat exchange fins, said fins extending into the flow path of hot exhaust gases exiting from said engine and providing a reactive surface means whereby said hot gases and compressed air may react more efficiently, said compressed air being ducted through an auxiliary air outlet duct sealably connected to a compressor air outlet duct, said compressor air outlet duct delivering compressed air to the power section air intake port.

15. The rotary engine of claim 1 further including an oil sump and oil pump means communicating with said sump, an oil filter means, an oil metering injection valve means, a compressor lubricating oil injection means and a power section lubricating oil injection means, said oil pump means having a plurality of outlet ducts for pumping oil to said oil filter means, said air intake filter means, said oil metering injection valve means, said compressor lubricating oil injection means, and said power section lubricating oil injection means.

16. The rotary engine of claim 15 wherein said oil metering injection valve means comprises an electrically actuated on-off valve means having a right electrically controlled solenoid winding, a left electrically controlled solenoid winding having inserted therethrough a magnetically permeable control rod, said having centrally located thereon a protruding triangularly shaped member in slidable abutment with a spring loaded needle mounted slidable and sealably in a needle cavity, said cavity being in a valve block, said valve block having an oil flow through-hole therein sealably connected at its left end to an oil inlet duct and at its right end to an oil outlet duct, said needle cavity communicating with said oil flow through-hole and having said spring loaded needle therein, said spring means maintaining said needle in an extended position with respect to a valve seat portion of said needle cavity, said valve block further having therein an oil flow limiting means comprising a threaded needle inserted into a threaded cavity in said valve block, said threaded cavity communicating with said oil flow through-hole, said threaded needle limiting or closing off oil flow when screwed into said threaded cavity, said solenoid windings, control rod and block being enclosed within an oil injection valve housing.

* * * * *